United States Patent [19]

Magett

[11] 4,214,296

[45] Jul. 22, 1980

[54] ROTATABLE LAMP FIXTURE

[76] Inventor: Fred M. Magett, 33 W. 83rd St., Chicago, Ill. 60620

[21] Appl. No.: 921,270

[22] Filed: Jul. 3, 1978

[51] Int. Cl.[2] ..... F21V 21/30

[52] U.S. Cl. ..... 362/35; 362/147; 362/272; 362/404; 362/806

[58] Field of Search ..... 362/35, 147, 271, 272, 362/363, 404, 407, 408, 423, 806, 811, 809, 369, 390; 350/289

[56] References Cited

U.S. PATENT DOCUMENTS

| | | | |
|---|---|---|---|
| 2,608,779 | 9/1979 | Joy | 362/809 |
| 3,133,263 | 5/1964 | Norberg | 362/35 |
| 3,271,735 | 9/1966 | Gosswiller | 362/35 |
| 3,694,649 | 9/1972 | Thompson | 362/369 |
| 3,784,809 | 1/1974 | Smith | 362/35 |
| 4,146,919 | 3/1979 | Jennings | 362/35 |

*Primary Examiner*—L. T. Hix
*Assistant Examiner*—Alan Mathews
*Attorney, Agent, or Firm*—Dulin, Thienpont & Potthast, Ltd.

[57] ABSTRACT

A rotating lamp fixture including a spherical shell member rotatably supported on a vertically extending support member, a platform disposed in the shell member, a drive motor mounted on the platform, a stationary gear secured to a vertical support member, the shell member being rotatably mounted on the support member, the motor being drivingly connected to the stationary gear and being effective when energized to rotate the platform and the shell in which it is supported about the vertical support member, and a light bulb socket suspended within the shell member.

15 Claims, 4 Drawing Figures

10
12
36
34
32
16
20
26
46
36
40
48
4
4
44a
44b
3
3
28
30
30
42
50
52a
52b
54
54
24
56
58

13
14
12
60
38
2
16
26
26
26
56
2

28
16
46
20
42
28
22
36
40
28
48
18
28

52a
44a
52b
44b
50
18

ROTATABLE LAMP FIXTURE

BACKGROUND OF THE INVENTION

This invention relates to a rotatable lamp fixture, and particularly one which may be rotated by motor means mounted within the fixture itself.

A principal object of this invention is to provide a rotating lamp fixture including a motor for rotating the fixture, the motor being mounted within the fixture itself.

Another object of the invention is to provide a rotatable lamp fixture in the nature of a hollow shell, the shell being rotatably supported on a support member disposed within the shell and including a motor mounted within the shell itself which when energized will be effective to rotate the spherical shell about the support member.

Other objects and advantages of the invention will become more apparent when considering the following description in conjunction with the accompanying drawings.

DESCRIPTION OF PREFERRED EMBODIMENT

Figure 2:
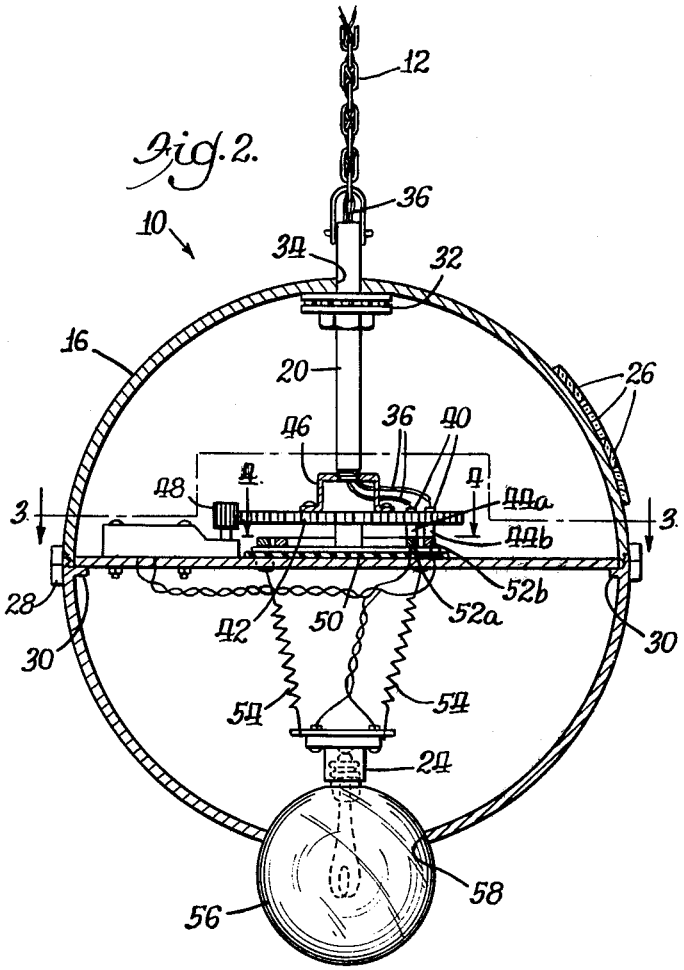
FIG. 2 is an enlarged sectional view taken through line 2—2 of FIG. 1 showing the motorized arrangement within a spherical shell for revolving the shell about a vertical support member.
Figure 1:
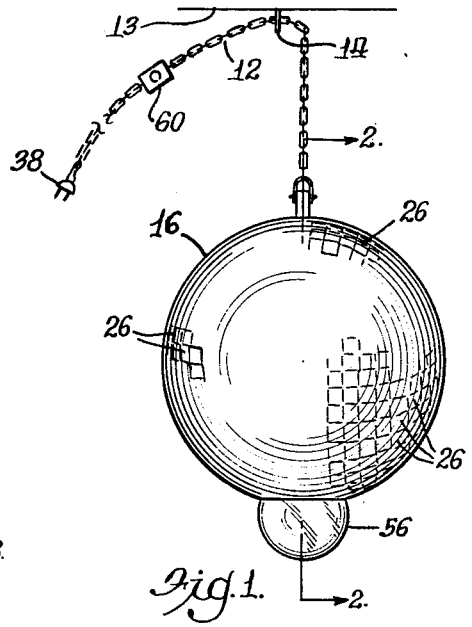
FIG. 1 illustrates a lamp fixture embodying the invention herein.
Figure 3:
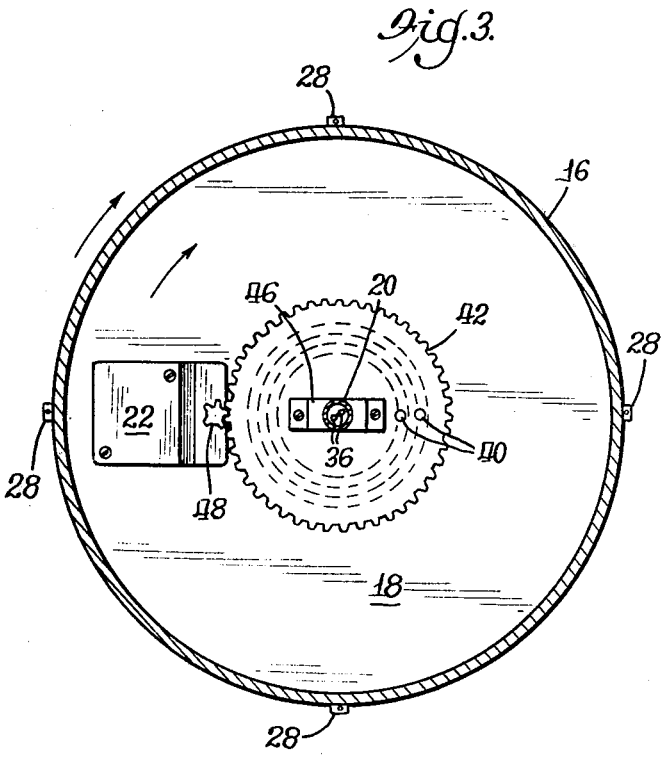
FIG. 3 is a plan view taken through line 3—3 of FIG. 2.
Figure 4:
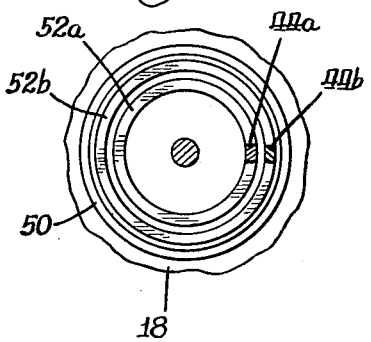
FIG. 4 is a plan view taken through line 4—4 of FIG. 2.

Turning now to the drawings wherein like reference characters in the several views refer to similar parts, 10 indicates generally a rotatable lamp fixture which may be suspended by a chain 12 from a room ceiling 13 by a hook 14 or other suitable means. The lamp fixture 10 comprises a spherical shell member 16 which may be made of two hemispherical shell portions, upper portion 16*a* and lower portion 16*b*. The fixture 10 also includes a support platform 18 mounted in the middle of the shell 16, a vertically extending support member 20 on which the spherical shell member is rotatably mounted, and a motor 22 mounted on the platform 18 for driving the spherical shell about its vertical support member and a light bulb socket 24 mounted within the shell.

The spherical shell may be of varying sizes. Examples of normal sizes may be anywhere from 12 inches to 24 inches in diameter but this is not to be construed as limiting the size in either direction. It will be apparent from the remaining description that the shell can be formed in other shapes, the spherical shape being used here as illustrative only. The shell member should be made of a rigid material, preferably a plastic or heavy cardboard. Even a light metal could be used if that would be desirable.

The outside surface of the spherical shell preferably has a reflective surface formed thereon. The outside surface may be covered with small pieces 26 of a mirror-like or other reflective substance so that when the shell is being rotated, light from a remotely positioned lamp may be directed onto the shell so that the mirror-like surfaces cast moving reflections on the walls and ceilings of the room in which the fixture is located.

The shell member 16 preferably is constructed in two halves or hemispherical portions 16*a* and 16*b* which may be attached together by suitable means such as a plurality of suitable latching mechanisms 28 to join the two halves. Other means may be used for securing the two halves together, and conceivably the two shell portions might be threaded onto each other.

Means is provided for supporting the motor 22 within the shell 16. Such support means preferably is a circular support platform 18 which is of a diameter substantially as large as the sphere diameter.

Means also is provided for supporting the platform 18 within the shell 16. This may be accomplished by providing ledge means attached to or formed integrally with the lower shell portion as indicated by the inwardly extending ledge section 30. The platform 18 may be secured to the ledges by gluing or other suitable means.

Support means is provided to rotatably support the shell member 16. Such support may include a vertically extending tubular member 20 on which is mounted a bearing assembly 32. One portion of the bearing assembly is attached to the upper end of the support member 20. The shell 16 may be constructed with an opening 34 in the upper surface thereof to permit the support member 20 to extend therethrough. It will be observed from FIG. 2 that the shell 16 rests on or is attached to the upper movable bearing portion.

Support member 20 preferably is of tubular construction so that electrical wiring 36 may extend therethrough and be connected at its outer end to an electrical plug 38 which is adapted to fit into any normal household electrical socket. The wiring extends from the lower end of the tube 20 and is connected to electrical terminals 40 which may be supported on the gear 42. These terminals extend through the gear 42 and terminate in electrical contacts 44*a* and 44*b* on the underside of gear 42.

The horizontally disposed gear 42 is attached to the lower end of the support member or tube 20 by means of a bracket 46 or other suitable means.

The motor 22 is mounted on the upper side of the support platform 18. The motor may be constructed with proper reduction gearing to drive a small pinion gear 48 which meshes with the large gear 42. Other means may also be provided, the objective to be achieved being to turn the shell slowly about its support member.

A plate 50 of insulating material may be disposed on and connected to the central portion of the platform 18. A pair of spaced concentric electrical contacts rings 52*a* and 52*b* are disposed in the plate 50 or at least are connected to the platform 18 and insulated from each other. These circumferentially extending contact rings 52*a* and 52*b* are contacted by the stationary electrical contacts 44*a* and 44*b* during the operation of the lamp fixture. While the circumferentially extending electrical contact rings 52*a* and 52*b* are here shown as disposed on the insulating disc, and consequently as the movable contacts, it will be appreciated that their position could be reversed with the stationary contacts connected to the lower portion of gear 42.

Adjusting means by way of an adjusting nut 53 positioned under the bearing assembly may be provided to adjust the height of the shell. This can be advantageously used to adjust the degree of contact between the movable and stationary electrical contacts.

An electrical light socket 24 is suspended from the lower side of the platform 18 and, of course, is appropriately electrically wired into the electrical wiring circuit along with the motor. The socket 24 may be suspended from the platform 18 or from the lower shell portion **16*b* either by a rigid connection, or as shown, by a plurality of resilient supports 54. If the latter type of suspension is used it is effective to bias a spherically shaped light bulb 56 as shown in FIG. 2 into contact with edge of the opening 58 in the lower part of the shell half 16*b*. Such an arrangement, of course, may be made to enhance the overall ornamental characteristics of the lamp. It will, of course, be recognized that other types of light bulbs can be used and that the light socket can be suspended in a variety of ways, either from the lower side of the platform 18 or from the inner wall of the lower shell half 16*b*. An on-off switch 60** may be incorporated in the electrical cord arrangement to control the on-off operation of the lamp fixture. This on-off switch may be a dimmer switch to further enhance the decorative effect of the lamp.

If desired the fixture also could have incorporated therein a sound speaker unit which could be appropriately connected to a radio receiver.

While the operation of the lamp fixture should be reasonably clear from the above description I will describe briefly its operation. When the switch 60 is turned on the motor is energized and the motor will drive the pinion gear 48. Since the large gear with which the pinion gear meshes is stationary, the motor, the platform and the entire shell member 16 will be driven slowly about the large gear 42.

In order to achieve some interesting lighting effects a floodlight or other directional light may be mounted somewhere in the room and directed onto the spherical shell member to which mirror reflecting surfaces or other reflecting surfaces have been glued or otherwise attached.

While the lamp fixture herein is illustrated as being hung from a support it should be recognized that the fixture could be supplied with a support mounting which would permit it to stand on a table or the like.

While a preferred embodiment of the invention has been disclosed it will be appreciated that this is shown by way of example only, and the invention is not to be limited thereto as other variations will be apparent to those skilled in the art and the invention is to be given its fullest possible interpretation within the terms of the following claims.

What is claimed is:

1. A self rotating lamp fixture comprising:

(a) a vertically extending support member;

(b) a hollow ornamental shell member rotatably mounted on said support member, said support member being disposed substantially within said shell member;

(c) means associated with said support member for rotatably supporting said shell member said associated means being constructed and arranged so that the entire shell member is adapted to rotate about said support member;

(d) a motor disposed within said shell member for rotating said shell member about said support member;

(e) motor support means disposed within said shell member for supporting said motor;

(f) drive means interconnecting said motor and said vertically extending support member;

(g) electrical circuitry including electrical wiring adapted to be connected to a source of electrical power and extending into said shell member and connected to provide a current path to said motor;

(h) said motor being effective when energized to rotate said shell member about said vertically extending support member.

2. The device of claim 1 wherein said means for supporting said shell member comprises bearing means connected to the upper end of said vertically extending support member.

3. The device of claim 1 wherein said drive means includes stationary drive means attached to said support member, and means driven by said motor and engaging said stationary drive means.

4. The device of claim 3 wherein said stationary drive means includes a relatively large gear attached to the lower end of said support member, and said means driven by said motor includes a relatively small gear which engages said relatively large gear.

5. The device of claim 1 wherein said motor support means includes a platform mounted within and secured to said shell member, for supporting said motor thereon.

6. The device of claim 1 wherein said motor support means includes a platform mounted within and secured to said shell member and electrical contact members supported on said platform.

7. The device of claim 1 including a light socket disposed within said shell member.

8. The device of claim 7 including resilient suspension means for supporting said light socket within the lower portion of said shell member.

9. The device of claim 8 including means defining opening means in the lower portion of said shell member adapted to receive therethrough a light bulb for insertion into said light socket, said opening means being slightly smaller than the light bulb whereby the resilient suspension means for said light socket is effective to bring the light bulb into contact with the edges defining said opening means.

10. The device of claim 7 including electrical circuitry connected to provide a current path to the light socket as well as the motor.

11. The device of claim 1 wherein said electrical wiring extends through said support member and is connected to stationary electrical contact means connected to the lower end of said support member.

12. The device of claim 11 wherein said drive means includes a stationary gear attached to the lower end of said support member, and said stationary electrical contact means is supported in said stationary gear.

13. The device of claim 1 including means connected to the upper end of said vertically extending support member for hanging the lamp fixture from a ceiling or wall support.

14. The device of claim 1 wherein said means for supporting said shell member comprises bearing means connected to said vertically extending support member, said drive means includes gearing drivingly interconnecting said motor and said support member, said motor support means includes a platform mounted within said shell member, said platform having electrical contact members supported thereon, and further including a light socket disposed within the lower portion of said shell member, and resilient suspension means for supporting said light socket within said shell member.

15. The device of claim 1 wherein said means for supporting said shell member comprises bearing means connected to the upper end of said vertically extending support member whereby the shell member is connected to said bearing means substantially at the zenith of the shell member.

* * * * *